US007432860B2

(12) United States Patent
Huynh

(10) Patent No.: US 7,432,860 B2
(45) Date of Patent: Oct. 7, 2008

(54) MULTI-BAND ANTENNA FOR GSM, UMTS, AND WIFI APPLICATIONS

(75) Inventor: Minh-Chau Huynh, Morrisville, NC (US)

(73) Assignee: Sony Ericsson Mobile Communications AB (SE)

( * ) Notice: Subject to any disclaimer, the term of this patent is extended or adjusted under 35 U.S.C. 154(b) by 56 days.

(21) Appl. No.: 11/435,535

(22) Filed: May 17, 2006

(65) Prior Publication Data

US 2007/0268190 A1 Nov. 22, 2007

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846

See application file for complete search history.

(56) References Cited

U.S. PATENT DOCUMENTS 5,898,405 A * 4/1999 Iwasaki ..... 343/700 MS
6,650,294 B2 11/2003 Ying et al.
6,727,855 B1 4/2004 Nalbandian
6,795,028 B2 9/2004 Stutzman et al.
2001/0043161 A1 11/2001 Tseng et al.
2003/0058169 A1 * 3/2003 Heyde ..... 343/700 MS

FOREIGN PATENT DOCUMENTS

WO WO0235652 5/2002

OTHER PUBLICATIONS

Invitation to Pay Additional Fees, International Application No. PCT/US2007/060304, Mailing Date: Nov. 22, 2007.

* cited by examiner

*Primary Examiner*—Tan Ho
(74) *Attorney, Agent, or Firm*—Coats & Bennett, P.L.L.C.

(57) ABSTRACT

The multi-band antenna described herein includes multiple antenna elements that collectively resonate in multiple different frequency bands. One exemplary antenna includes first and second vertically spaced antenna elements that connect to a ground plane. A feed antenna element positioned between the first and second antenna elements connects to an antenna feed. The electromagnetic coupling produced by the arrangement of these antenna elements produces multiple resonant frequencies, and therefore, defines multiple operating frequency bands of the multi-band antenna.

29 Claims, 8 Drawing Sheets

MULTI-BAND ANTENNA FOR GSM, UMTS, AND WIFI APPLICATIONS

BACKGROUND

The present invention generally relates to antennas for mobile communication devices, and more specifically relates to multi-band antennas covering multiple frequency bands.

Currently, wireless networks operate according to a wide variety of communication standards and/or in a wide range of frequency bands. In order to accommodate multiple frequency bands and/or multiple communication standards, many mobile communication devices include a wideband antenna that covers multiple frequency bands or include a different antenna for each frequency band. However, as manufacturers continue to design smaller mobile communication devices, including multiple antennas in a mobile communication device becomes increasingly impractical. Further, while wideband antennas often cover multiple frequency bands, they typically do not cover all desired frequency bands. For example, while an antenna may cover either an 850 MHz frequency band commonly used in the United States or a 900 MHz frequency band commonly used in Europe, conventional antennas typically do not cover both frequency bands. As such, one mobile communication device is generally only compatible with either the European network or the U.S. network. Therefore, there remains a need for alternative mobile communication device antennas.

SUMMARY

A multi-band antenna according to the present invention includes multiple antenna elements that collectively cover multiple different frequency bands. One exemplary embodiment comprises first and second vertically spaced antenna elements connected to a ground plane. A feed antenna element connected to an antenna feed is positioned between the first and second antenna elements. The electromagnetic coupling produced by the arrangement of these antenna elements produces multiple resonant frequencies, and therefore, defines multiple operating frequency bands of the multi-band antenna.

DETAILED DESCRIPTION

Figure 1:
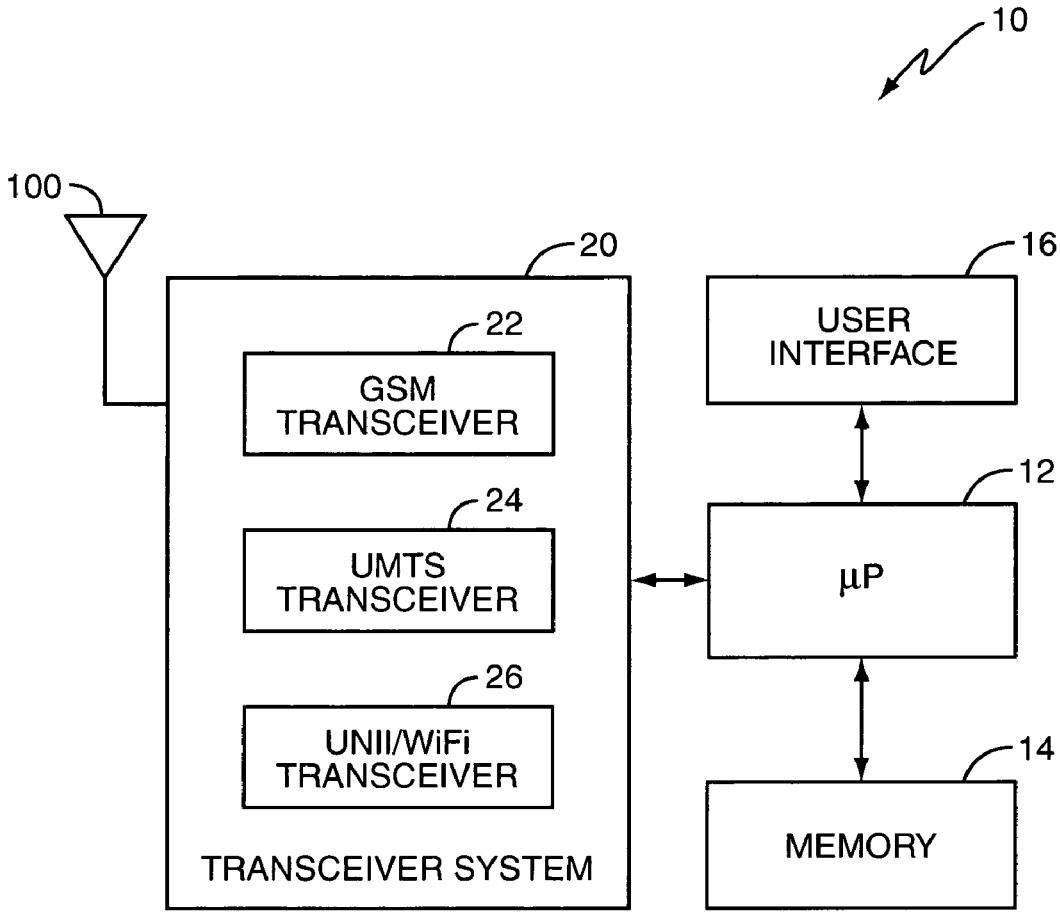
FIG. 1 shows a block diagram of an exemplary mobile communication device according to one embodiment of the present invention.

FIG. 1 illustrates an exemplary multi-band mobile communication device 10 that uses a single multi-band antenna 100 to transmit and receive wireless signals in multiple frequency bands. Mobile communication device 10 includes a controller

12, memory 14, user interface 16, and transceiver system 20. Controller 12 controls the operation of wireless communication device 10 responsive to programs stored in memory 14 and instructions provided by the user via user interface 16. Transceiver system 20 includes multiple transceivers 22-26 that communicate wireless speech and data signals to and from a base station in a wireless communications network (not shown) via a single multi-band antenna 100. Transceivers 22-26 may be fully functional cellular radio transceivers that operate according to any known standard, including the standards known generally as GSM, TIA/EIA-136, cdmaOne, cdma2000, UMTS, UNII, and Wideband CDMA. In one embodiment, different transceivers 22-26 operate according to different communication standards. For example, transceiver 22 may operate according to the GSM standard, while transceiver 24 and transceiver 26 may operate according to the UMTS and UNII standards, respectively, as shown in FIG. 1. While FIG. 1 shows a transceiver system 20 with three transceivers 22-26, it will be appreciated that antenna 100 may be connected to any desired number of transceivers configured to operate in any desired frequency band and/or according to any desired communication standard.

Multi-band antenna 100 transmits and receives signals at frequencies in multiple frequency bands. In one exemplary embodiment, multi-band antenna 100 covers the full range of frequencies defined by the GSM and UMTS standards, and covers the lower frequency bands defined by the UNII for WiFi standard.

TABLE 1

| Band | TX, MHz | RX, MHz |
|---|---|---|
| | GSM Frequency Bands | |
| 850 | 824-849 | 869-894 |
| 900 | 880-915 | 925-960 |
| 1800 | 1710-1785 | 1805-1880 |
| 1900 | 1850-1910 | 1930-1990 |
| | UMTS Frequency Bands | |
| I | 1920-1980 | 2110-2170 |
| II | 1850-1910 | 1930-1990 |
| III | 1710-1785 | 1805-1880 |
| IV | 1710-1755 | 2110-2155 |
| V | 824-849 | 869-894 |
| VI | 830-840 | 875-885 |

| UNII 5 GHz Frequency Bands (WiFi) | |
|---|---|
| Band | TX/RX, GHz |
| I | 5.15-5.25 |
| II | 5.25-5.35 |
| III | 5.470-5.725 |
| IV | 5.725-8.825 |

As shown in Table 1, the combination of the frequency requirements for these three communication standards covers three distinct frequency bands: 824-960 MHz, 1710-2170 MHz, and 5.15-5.35 GHz, referred to herein as "low," "middle," and "high" frequency bands, respectively. The following describes antenna 100 in terms of these three frequency bands. However, it will be appreciated that the antenna 100 of the present invention is not limited to three frequency bands or to the above-specified three frequency bands.

Figure 2:
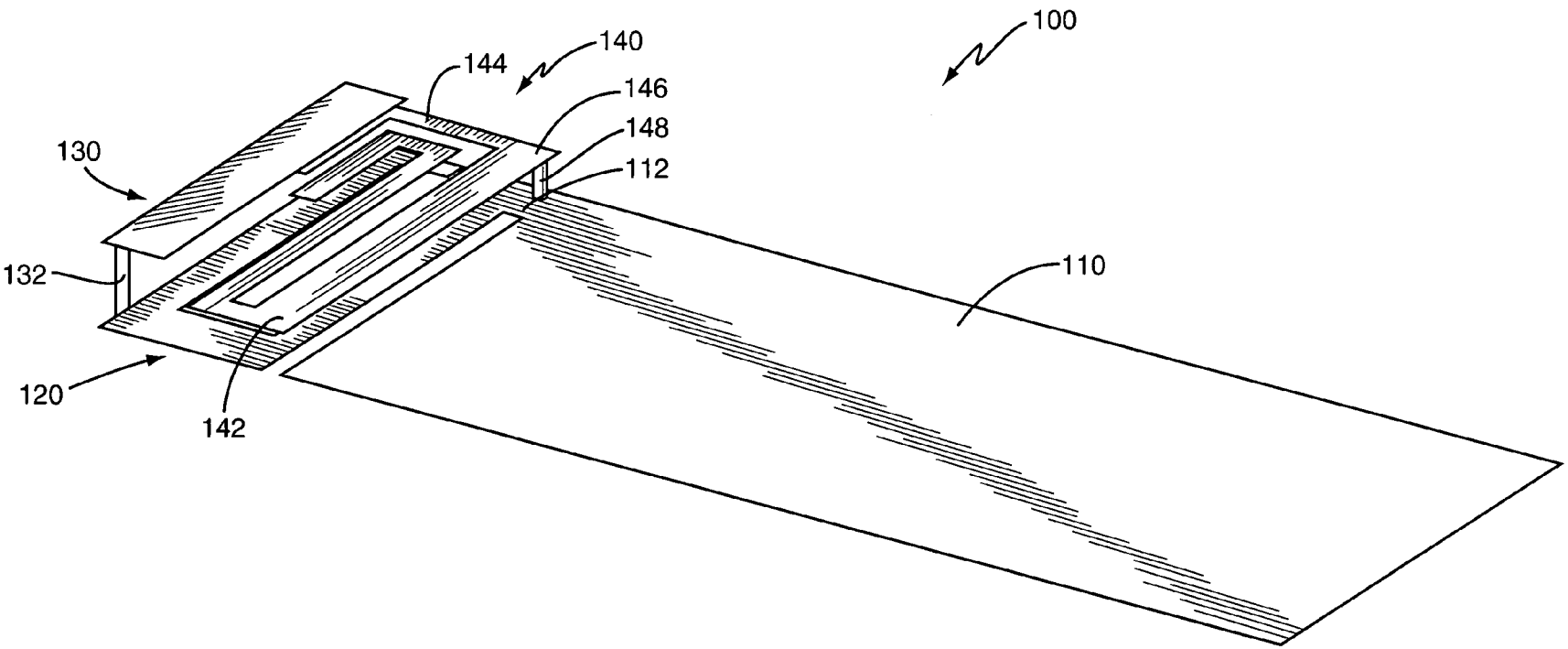
FIG. 2 shows a perspective view of one exemplary multi-band antenna for the mobile communication device of FIG. 1.

As shown in FIG. 2, multi-band antenna 100 includes a ground plane 110, a first antenna element 120 connected to the ground plane by a ground connector 112, a second antenna element 130 vertically spaced from the first antenna element 120, and a feed antenna element 140 positioned between the first and second antenna elements 120, 130. Feed element 140 includes first and second branches 142, 144 connected at a common end 146 to an antenna feed 148. Collectively, the antenna elements 120-140 transmit wireless communication signals in one or more frequency bands, such as the low, middle, and high frequency bands discussed above. Further, antenna elements 120-140 receive wireless communication signals transmitted in the one or more frequency bands and provide the received signals to the transceiver system 20.

The size, relative orientation, and shape of antenna elements 120-140 control the resonant frequencies of the antenna elements 120-140. The combination of these resonant frequencies in turn defines the operating frequency bands of antenna 100. The following describes the size, relative orientation, and shape of each antenna element 120-140 of the exemplary multi-band antenna 100 shown in FIGS. 2-4.

In general, the length of an antenna impacts the resonant frequency of the antenna. In the exemplary embodiment, the length of the ground plane ($L_G$), the path length of the first antenna element 120 ($PL_1$), the path length of the second antenna element 130 ($PL_2$), and the path length of the first and second branches 142, 144 of the feed antenna element 140, ($PL_{3a}$, and $PL_{3b}$, respectively) collectively define the resonant frequencies of antenna 100. As used herein, $PL_1$ refers to the total path length between ground connector 112 and the distal end 122 of the first antenna element 120, while $PL_2$ refers to the total path length between ground connector 112 and the distal end 134 of the second antenna element 130. Similarly, as used herein, $PL_{3a}$ and $PL_{3b}$ refer to the total path lengths between the common end 146 and the distal ends 150, 152 of the first and second branches 142, 144, respectively, the feed antenna element 140.

The frequency response of antenna 100 at the low frequency band is similar to the frequency response of a half-wave dipole antenna. Therefore, the overall path length for a signal traveling along the ground plane and any antenna element connected to the ground plane should be approximately set to ½λ. See, for example, Equation (1), where c corresponds to the speed of light, f corresponds to frequency in hertz, and λ corresponds to wavelength in meters.

$$L_G + PL_1 = \frac{1}{2}\lambda = \frac{1}{2}\left(\frac{c}{f}\right) \tag{1}$$

Assuming $L_G \geqq PL_1$ and setting the desired resonant frequency to 850 MHz, Equation (1) sets $PL_1$ and $L_G$ to approximately 88 mm. Thus, when $L_G$ is greater than or equal to 88 mm, and when $P_L$, is approximately equal to 85 mm, antenna 100 resonates at 850 MHz.

Because second antenna element 130 connects to the first antenna element 120, the second antenna element 130 also connects to ground plane 110. Therefore, the sum of $L_G$ and $PL_2$ should also be approximately equal to ½λ. For f=850 MHz, this requirement also sets $PL_2$ at approximately 85 mm.

Similar considerations define other size characteristics of antenna elements 120-140, such as the path lengths of the first and second branches 142, 144 of the feed antenna element 140, the width of the antenna elements 120-140, etc. For example, the path lengths of the first and second branches 142, 144, $PL_{3a}$ and $PL_{3b}$, respectively, are at least partially defined by a desired resonant frequency of 900 MHz and 1900 MHz, respectively. For the exemplary embodiment illustrated in FIG. 4, the resulting antenna 100 and antenna elements 120-140 have the dimensions shown in Table 2.

TABLE 2

| | |
|---|---|
| Antenna | L = 40 mm |
| | W = 15 mm |
| | H = 6 mm |
| First antenna element | Total path length = 85 mm |
| | a = 13.5 mm |
| | b = 40 mm |
| | c = 7 mm |
| | d = 3 mm |
| | e = 6 mm |
| | f = 4 mm |
| Second antenna element | Total path length = 85 mm |
| | h = 35 mm |
| | g = 5 mm |
| Feed antenna element | Total path length of first branch = 85 mm |
| | Total path length of second branch = 30 mm |
| | i = 14 mm |
| | j = 15 mm |
| | k = 40 mm |
| | l = 8 mm |
| | m = 34 mm |
| | n = 14 mm |
| | o = 6 mm |
| | p = 2 mm |
| | q = 2 mm |
| | r = 4 mm |
| | s = 3 mm |
| | t = 2 mm |
| | u = 2 mm |
| | v = 2 mm |

The relative orientation and shape of each antenna element 120-140 also impacts the frequency response of antenna 100. It will be appreciated that the above-described size requirements directly impact the relative orientation and shape of the antenna elements 120-140. In the embodiment shown in FIGS. 2-4, first antenna element 120 is generally U-shaped and positioned in the same plane as the ground plane 110. One corner of the generally U-shaped element 120 connects to the ground plane 110 via a ground connector 112. This shape enables the first antenna element 120 to achieve the desired path length within a small area.

The second antenna element 130 is generally I-shaped and vertically spaced above first antenna element 120. In one exemplary embodiment, first and second antenna elements are separated by 6 mm. A conducting strip 132 electrically connects second antenna element 130 to a middle section of the first antenna element 120, opposite the corner connected to ground connector 112. As shown in the figures, the generally I-shaped element 130 overlaps at least a portion of first antenna element 120.

Figure 3A:
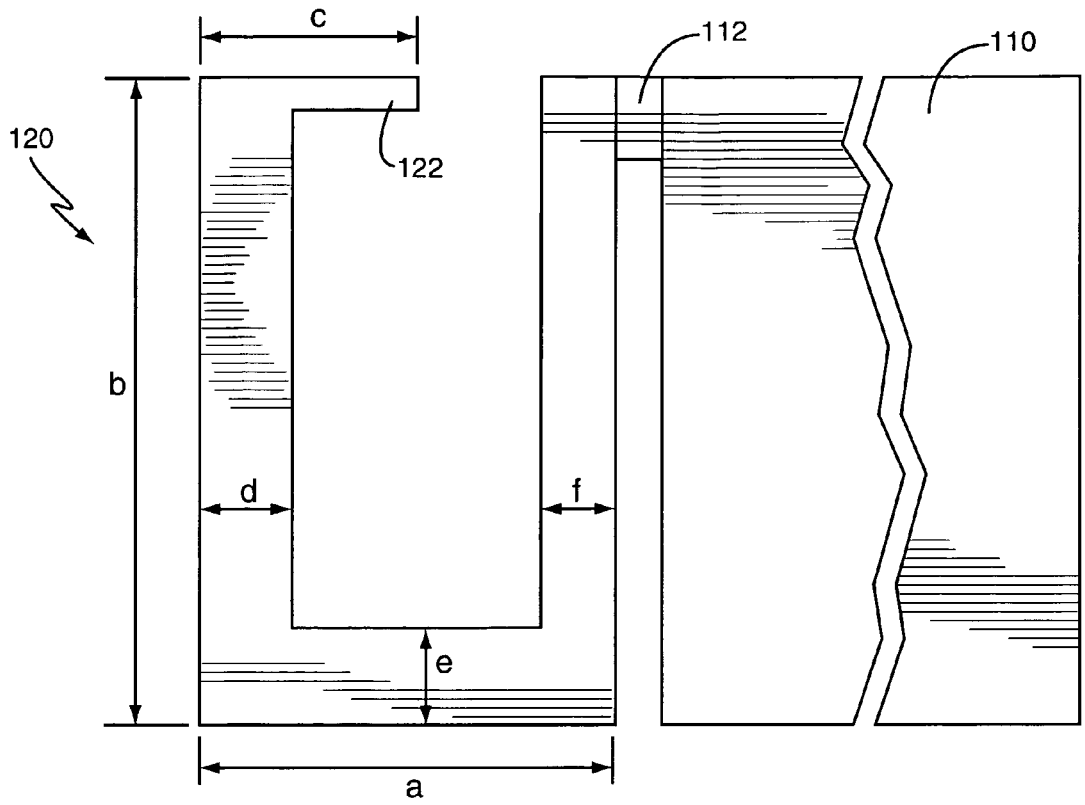
FIGS. 3A-3C show a schematic of individual antenna elements for the multi-band antenna of FIG. 2.
Figure 3B:
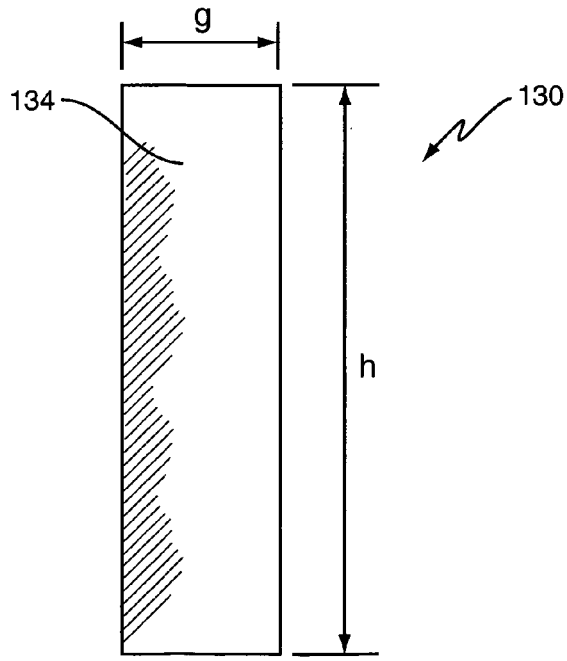
Figure 3C:
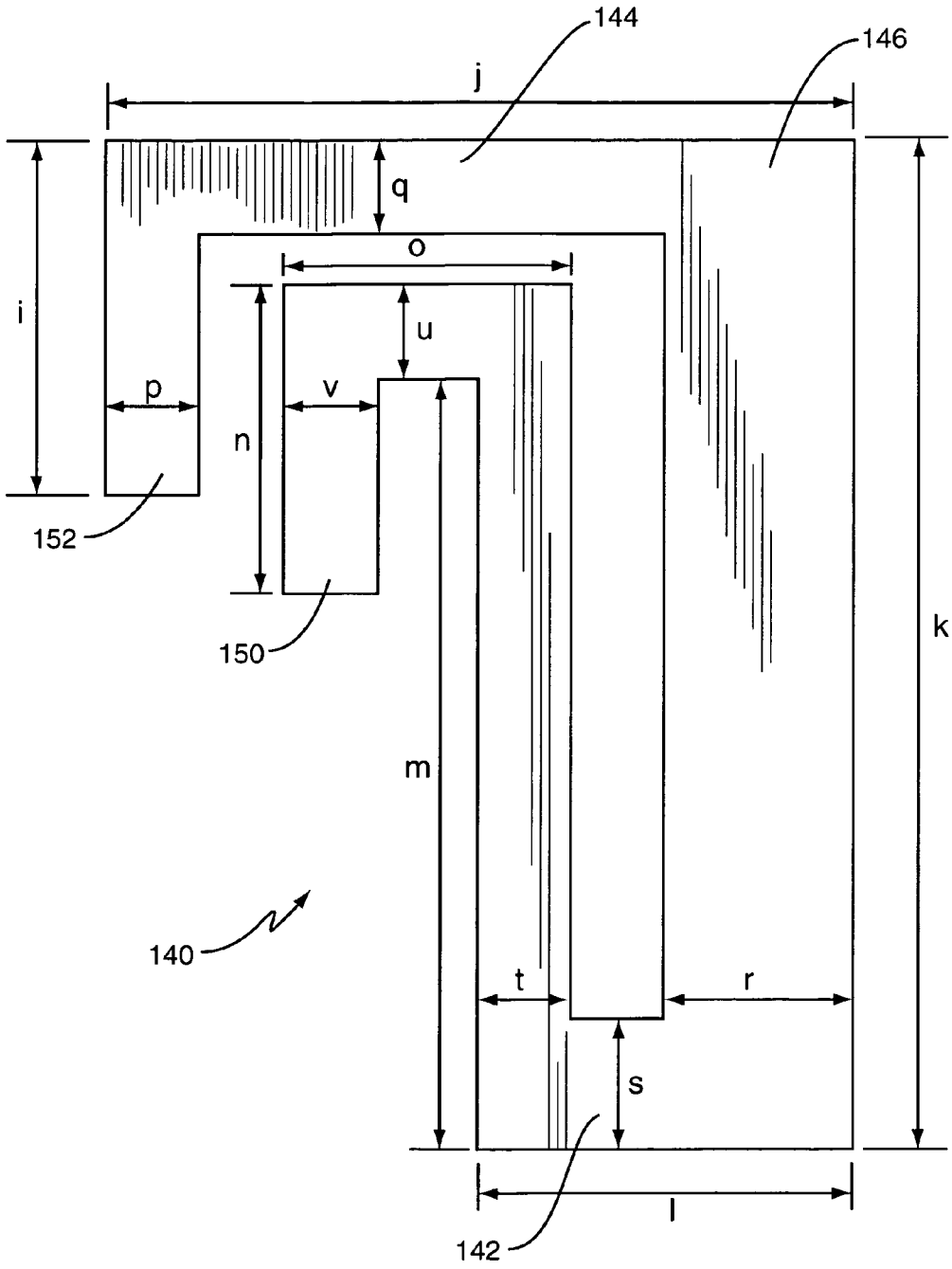
Figure 3D:
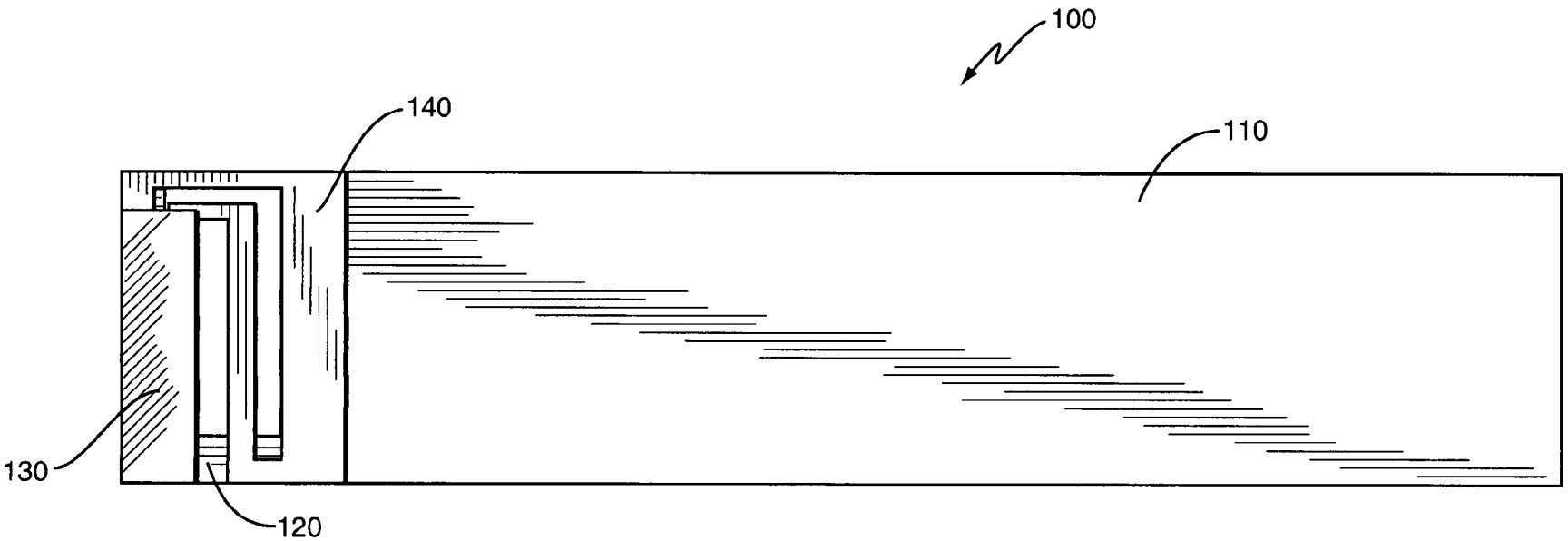
FIG. 3D shows a top view of a schematic of the antenna of FIG. 2.

Feed antenna element 140 is positioned between the first and second antenna elements 120,130. In one exemplary embodiment, feed antenna element 140 is positioned midway between the first and second antenna elements 120, 130. The first branch 142 of the feed antenna element 140 is generally S-shaped, while the second branch 144 is generally L-shaped. As shown in FIG. 3B, the generally L-shaped second branch 144 wraps around one portion of the S-shaped first branch 142. The shapes of the first and second branches 142, 144 enable each branch to achieve the desired path length while keeping the area of the second antenna element 130 within the boundaries defined by first antenna element 120. Further, the shapes of first and second branches 142,144 position the distal ends 150,152 beneath the second antenna element 130 such that second antenna element 130 overlaps the distal ends 150,152.

When designed according to the above size, relative orientation, and shape requirements, antenna elements 120-140 electro-magnetically couple to produce the resonant frequencies of multi-band antenna 100. Specifically, the electro-magnetic coupling between the antenna elements 120-140 causes each antenna element to resonate at different fundamental mode, first harmonic, and second harmonic frequencies. These resonant frequencies define the lower and upper boundaries of the multiple frequency bands of antenna 100.

Figure 4:
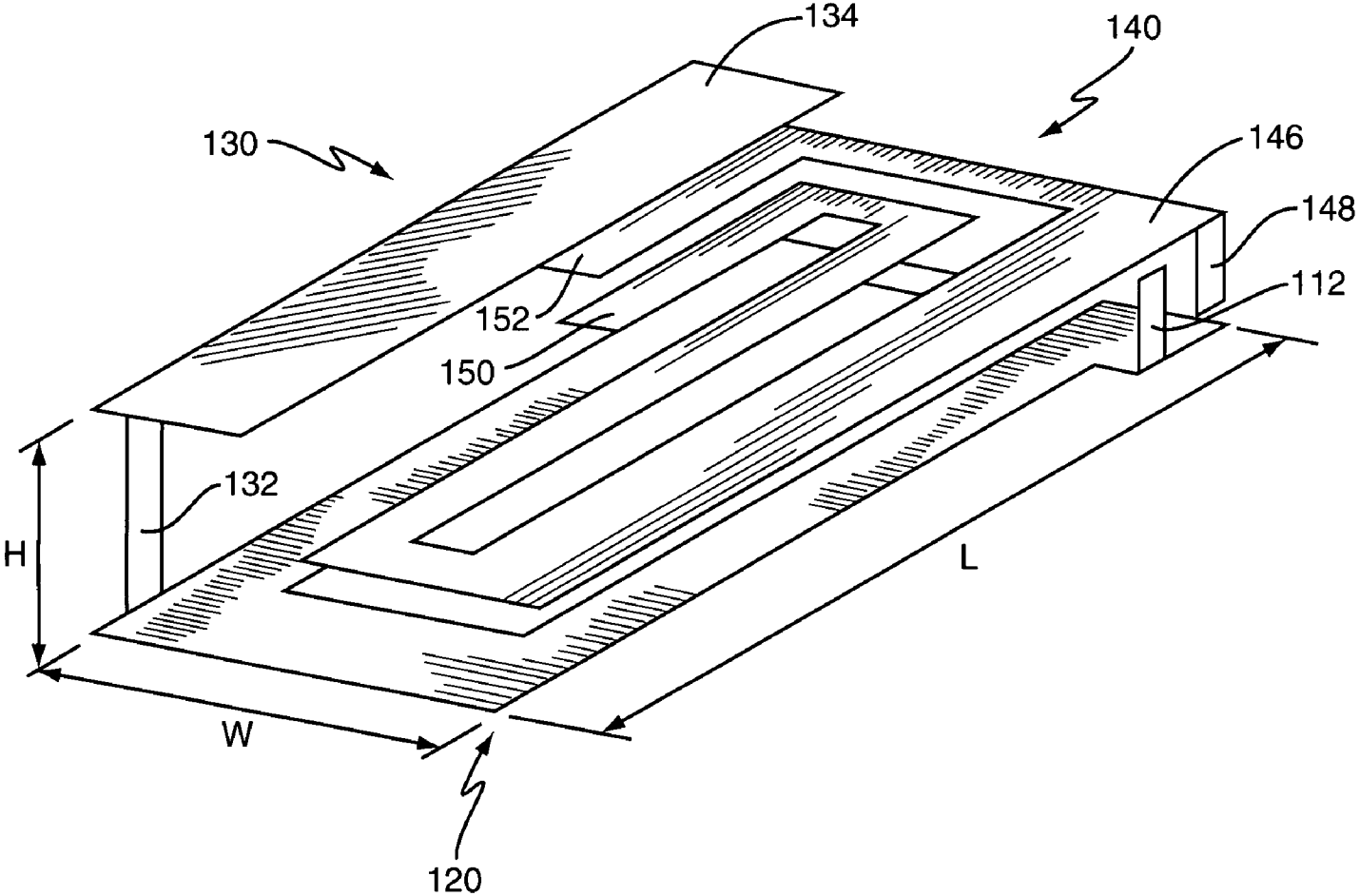
FIG. 4 shows a perspective view of the assembled antenna elements of the multi-band antenna of FIG. 2.

The following details the frequency response of each antenna element for the exemplary embodiment illustrated in FIGS. 2-4. In this embodiment, feed antenna element 140 resonates at a fundamental mode frequency of 900 MHz. In addition, the feed antenna element 140 resonates at a first harmonic frequency in the higher portion of the middle frequency band and at a second harmonic frequency in the high frequency band. The second branch 144 of the feed antenna element 140 resonates at a fundamental mode frequency of 1900 MHz, and further resonates at a first harmonic frequency in the high frequency band. As discussed above, the second antenna element 130 resonates at a fundamental mode frequency of 850 MHz, and at a first harmonic frequency in the middle frequency band. Lastly, the first antenna element 120 resonates at a fundamental mode frequency of 850 MHz, at a first harmonic frequency in the higher portion of the middle frequency band, and at a second harmonic frequency in the high frequency band. The combination of these resonant frequencies defines the frequency response of multi-band antenna 100.

Figure 5:
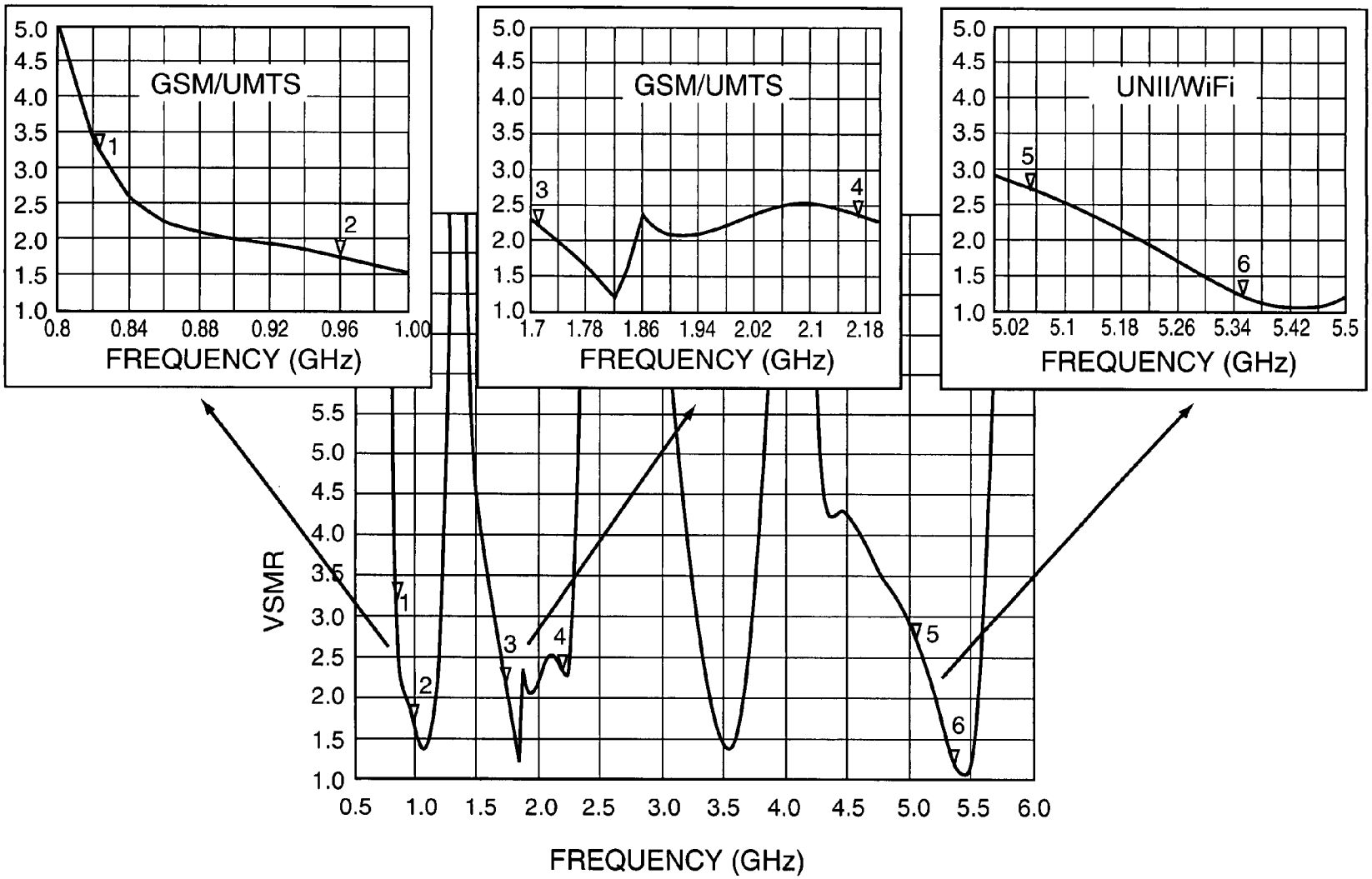
FIG. 5 shows performance results for the multi-band antenna of FIG. 2.

FIG. 5 illustrates test data from an exemplary multi-band antenna 100 built to the specifications discussed above. As shown in FIG. 5, multi-band antenna 100 covers all frequency bands defined by GSM and UMTS, and further covers the lower end of the frequency band defined for UNII for WiFi.

Figure 6:
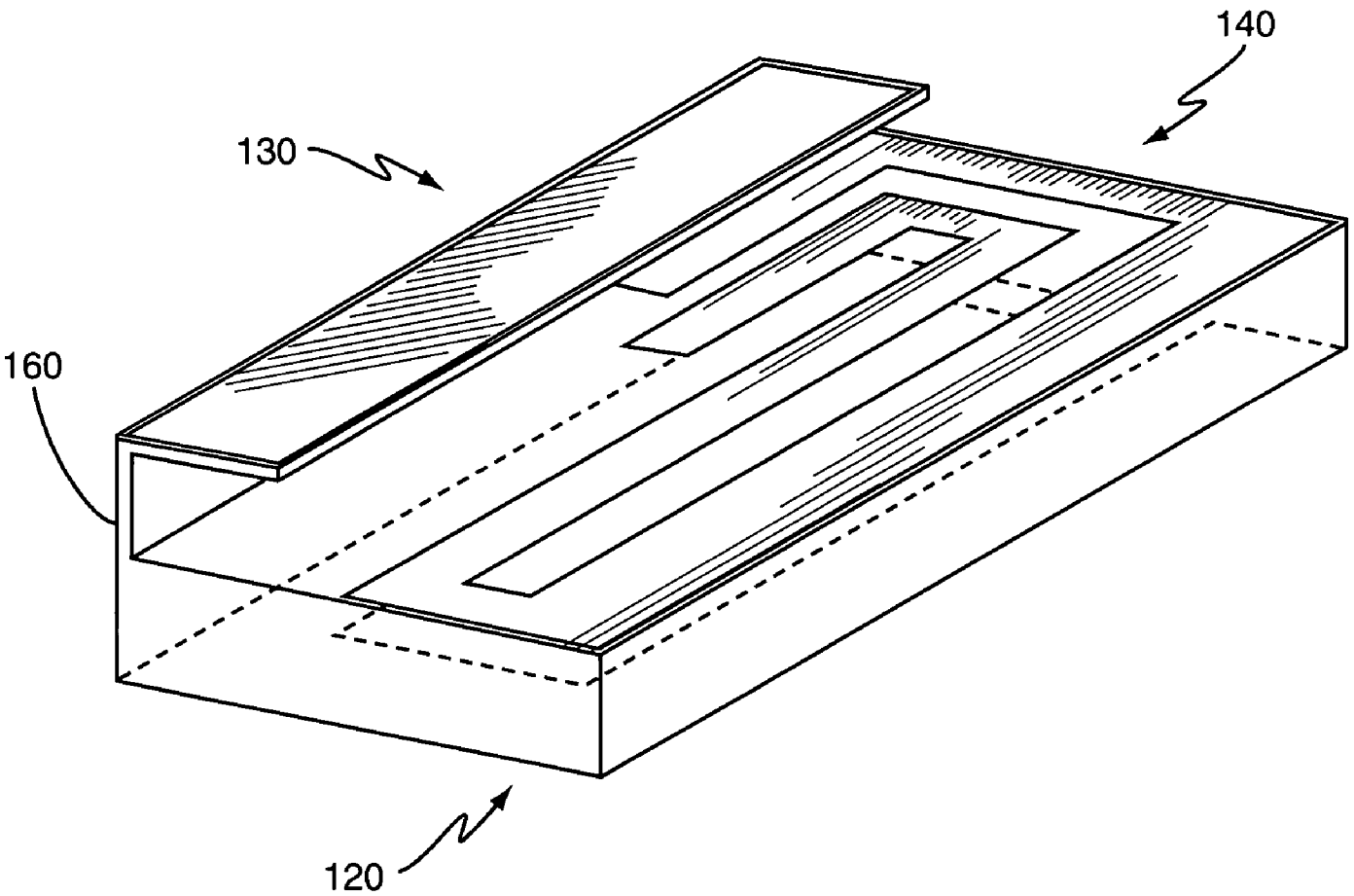
FIG. 6 shows an exemplary carrier frame for the antenna of FIG. 4.

Multi-band antenna 100 may be constructed from any known materials. In one exemplary embodiment, antenna 100 is constructed on flex film and supported by a plastic carrier frame 160, as shown in FIG. 6, while the ground plane is constructed with conventional printed circuit board materials. Carrier frame 160 orients each antenna element as described above and reduces the dielectric constant between the antenna elements 120-140 by eliminating any need for additional dielectric spacing materials Therefore, except for the areas where the carrier frame 160 is positioned between antenna elements, the air provides a dielectric constant of 1 between the antenna elements 120-140. While not explicitly shown, carrier frame 160 may include an open area beneath feed antenna 140 to further reduce the dielectric constant between feed antenna element 140 and the first antenna element 120, and to prevent any unnecessary loading on the antenna 100.

The above-described multi-band antenna 100 provides a single antenna that covers multiple different frequency bands of different communication standards. As a result, a mobile communication device 10 that uses the multi-band antenna 100 described herein may operate in different wireless communication networks that function according to different communication standards without requiring multiple antennas. For example, a single mobile communication device 10 having multi-band antenna 100 may operate in wireless communication networks in the United States, Europe, Asia, etc., that operate in both the 850 MHz and the 900 MHz frequency bands of the GSM standard. In addition, the compactness of the above-described multi-band antenna 100 makes it ideal for any mobile communication devices 10, such as cellular telephones, personal data assistants, palmtop computers, wireless PC cards, etc., that operate within a wireless network. Further, because multi-band antenna 100 is not constructed with high dielectric substrate, the cost of the antenna 100 is relatively cheap when compared to conventional antennas. Therefore, the multi-band antenna 100 described herein provides significant performance, size, and cost improvements over conventional designs.

The above describes multi-band antenna 100 in terms of the low, middle, and high frequency bands associated with the GSM, UMTS, and UNII for WiFi wireless communication standards. However, the present invention may be used for other standards operating in different frequency bands. Adjustments in the path length of one or more antenna elements and/or adjustments in the relative orientation of the different antenna elements may adjust the resonant frequencies of antenna 100. Such adjustments may be used to change the bandwidth and/or the frequency band(s) covered by antenna 100.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A multi-band antenna comprising:

first and second vertically spaced antenna elements connected to a ground plane, wherein the first antenna element is disposed in the same plane as the ground plane; and a feed antenna element connected to an antenna feed and disposed between the first and second antenna elements, said feed antenna element comprising first and second branches arranged to electro-magnetically couple with the first and second antenna elements to define multiple operating frequency bands of the multi-band antenna.

2. The multi-band antenna of claim 1 wherein the second antenna element overlaps distal ends of the first and second branches of the feed antenna element.

3. The multi-band antenna of claim 2 wherein the distal end of at least one of the first and second branches overlaps a portion of the first antenna element.

4. The multi-band antenna of claim 1 wherein the first branch of the feed antenna element is generally S-shaped, and wherein the second branch of the feed antenna element is generally L-shaped.

5. The multi-band antenna of claim 1 wherein the first and second branches of the feed antenna element connect at a common end, and wherein the common end electrically connects to the antenna feed.

6. The multi-band antenna of claim 1 wherein the feed antenna element is disposed mid-way between the first and second antenna elements.

7. The multi-band antenna of claim 1 wherein the first antenna element is generally U-shaped, and wherein a first end of the generally U-shaped first antenna element connects to the ground plane via a ground connector.

8. The multi-band antenna of claim 7 wherein the second antenna element is generally I-shaped, and wherein the multi-band antenna further comprises a conducting strip that electrically connects one end of the generally I-shaped second antenna element to a middle section of the generally U-shaped first antenna element.

9. The multi-band antenna of claim 8 wherein the ground connector and the conducting strip connect to opposing corners of the generally U-shaped first antenna element.

10. The multi-band antenna of claim 1 wherein the multi-band antenna covers first, second, and third frequency bands.

11. The multi-band antenna of claim 10 wherein a Global System for Mobile communications standard defines the first frequency band, a Universal Mobile Telecommunication System standard defines the second frequency band, and an Unlicensed National Information Infrastructure standard defines the third frequency band.

12. The multi-band antenna of claim 1 wherein a path length of the first antenna element and a path length of the second antenna element have approximately the same length.

13. The multi-band antenna of claim 12 wherein a length of the ground plane is greater than or equal to at least one of the path lengths of the first and second antenna elements.

14. The multi-band antenna of claim 12 wherein a length of the ground plane is greater than or equal to ¼ of a wavelength corresponding to an operating frequency of the multi-band antenna.

15. A mobile communication device comprising:

a multi-band antenna comprising:

first and second vertically spaced antenna elements connected to a ground plane, wherein the first antenna element is disposed in the same plane as the ground plane; and a feed antenna element connected to an antenna feed and disposed between the first and second antenna elements, said feed antenna element comprising first and second branches arranged to electro-magnetically couple with the first and second antenna elements; and a transceiver system configured to transmit and receive wireless communication signals via the multi-band antenna.

16. The mobile communication device of claim 15 wherein the second antenna element overlaps distal ends of the first and second branches of the feed antenna element.

17. The mobile communication device of claim 15 wherein the multi-band antenna covers first, second, and third frequency bands.

18. The mobile communication device of claim 17 wherein a Global System for Mobile communications standard defines the first frequency band, a Universal Mobile Telecommunication System standard defines the second frequency band, and an Unlicensed National Information Infrastructure standard defines the third frequency band.

19. A method of constructing a multi-band antenna comprising:

connecting first and second vertically spaced antenna elements to a ground plane, wherein the first antenna element is disposed in the same plane as the ground plane; and disposing a feed antenna element connected to an antenna feed between the first and second antenna elements, said feed antenna element comprising first and second branches arranged to electro-magnetically couple to the first and second antenna elements.

20. The method of claim 19 further comprising overlapping distal ends of the feed antenna element with at least one portion of the second antenna element.

21. The method of claim 19 further comprising generally arranging the first branch of the feed antenna element in an S-shape and generally arranging the second branch of the feed antenna element in an L-shape.

22. The method of claim 19 further comprising:

connecting the first and second branches at a common end; and electrically connecting the common end to the antenna feed.

23. The method of claim 19 further comprising:

generally arranging the first antenna element in a U-shape; and connecting a first end of the generally U-shaped first antenna element to the ground plane via a ground connection.

24. The method of claim 23 further comprising:

generally arranging the second antenna element in an I-shape; and electrically connecting one end of the generally I-shaped second antenna element to a middle section of the generally U-shaped first antenna element using a conducting strip vertically disposed between the first and second antenna elements.

25. The method of claim 19 wherein the multi-band antenna covers first, second, and third frequency bands.

26. The method of claim 25 wherein a Global System for Mobile communications standard defines the first frequency band, a Universal Mobile Telecommunication System standard defines the second frequency band, and an Unlicensed National Information Infrastructure standard defines the third frequency band.

27. A multi-band antenna comprising:

a generally U-shaped first antenna element, wherein a first end of the generally U-shaped first antenna element connects to a ground plane via a ground connector;

a generally I-shaped second antenna element connected to the ground plane and vertically spaced from the first antenna element;

a conducting strip to electrically connect one end of the generally I-shaped second antenna element to a middle section of the generally U-shaped first antenna element; and a feed antenna element connected to an antenna feed and disposed between the first and second antenna elements, said feed antenna element comprising first and second branches arranged to electro-magnetically couple with the first and second antenna elements to define multiple operating frequency bands of the multi-band antenna.

28. The multi-band antenna of claim 27 wherein the ground connector and the conducting strip connect to opposing corners of the generally U-shaped first antenna element.

29. A method of constructing a multi-band antenna comprising:

connecting a generally U-shaped first antenna element to a ground plane via a ground connection;

connecting a generally I-shaped second antenna element to the ground plane, wherein the second antenna element is vertically spaced from the first antenna element;

electrically connecting one end of the generally I-shaped second antenna element to a middle section of the generally U-shaped first antenna element using a conducting strip vertically disposed between the first and second antenna elements; and disposing a feed antenna element connected to an antenna feed between the first and second antenna elements, said feed antenna element comprising first and second branches arranged to electro-magnetically couple to the first and second antenna elements.

* * * * *